United States Patent [19]

Ernst

[11] 4,288,980

[45] Sep. 15, 1981

[54] COMBUSTOR FOR USE WITH GAS TURBINES

[75] Inventor: Hermann Ernst, Saint Cloud, Minn.

[73] Assignee: Brown Boveri Turbomachinery, Inc., Saint Cloud, Minn.

[21] Appl. No.: 50,176

[22] Filed: Jun. 20, 1979

[51] Int. Cl.[3] ..... F23R 3/06; F23R 3/26; F23R 3/36; F23R 3/54

[52] U.S. Cl. ..... 60/39.23; 60/746; 60/759; 60/760

[58] Field of Search ..... 60/752, 730, 760, 39.23, 60/742, 746; 431/242, 243

[56] References Cited

U.S. PATENT DOCUMENTS

| | | | |
|---|---|---|---|
| 2,446,059 | 7/1948 | Peterson | 60/39.23 |
| 2,716,330 | 8/1955 | Way | 60/760 |
| 2,795,372 | 6/1957 | Szyolowski | 60/39.07 |
| 3,016,703 | 1/1962 | Lorett | 60/752 |
| 3,236,279 | 2/1966 | Beyer | 60/746 |
| 3,280,555 | 10/1966 | Charpentier | 60/39.23 |
| 3,777,983 | 12/1973 | Hibbins | 60/742 |

*Primary Examiner*—Robert E. Garrett
*Attorney, Agent, or Firm*—Daniel H. Bobis

[57] ABSTRACT

A counter flow combustor has a generally elongated hollow cylindrical outer casing or shell with a closure means at the upper end defining a head space and a generally elongated smaller hollow annular inner casing or combustion wall mounted therein in spaced relation to the outer casing to form an annular head space extension between the side walls of the outer casing and the inner casing which is continuous with the head space. The inner casing or combustion wall defines a primary combustion zone, and a secondary combustion zone in communication at one end with the primary combustion zone and at the end remote therefrom with the discharge outlet for delivering combustion gases from the combustor. An inlet assembly is mounted in said head space for mixing fuel and air and for delivering the same in proper ratio for combustion in said primary combustion zone and secondary combustion zone. An annular air inlet passage is formed in the combustor at the end remote from the inlet assembly and a plurality of cooling tubes mounted on the inside wall of the inner casing or combustion wall communicates at one end with the air inlet passage and at the end remote therefrom with the head space and inlet assembly so as to utilize almost all of the entering air first for cooling the wall of the inner casing or combustion wall and then to pass the same to the inlet assembly for mixture with the fuel to be burned in the primary combustion zone, such air flow passing in counter flow relation to the combustion gases passing through the primary combustion zone and secondary combustion zone and being discharged through the discharge outlet for the combustor.

13 Claims, 16 Drawing Figures

COMBUSTOR FOR USE WITH GAS TURBINES

BACKGROUND OF THE INVENTION

The present invention is concerned generally with fuel combustors suitable for use with gas turbines, and more particularly relates to a fuel combustor with improved cooling components for cooling the combustion chamber wall, and furthermore relates to a fuel combustor capable of alternatively and selectively burning liquid or gaseous fuels including, low heat content gaseous fuels.

Prior art combustors have not been designed to satisfactorily burn, both safely and stably, gaseous fuels of low heat content values, such as those gaseous fuels available from shale oil extraction processes. During shale oil extraction, a process offgas is yielded which is of a low heat content, but is still attractive enough for burning in gas turbine power plants especially for the generation of on and off site electrical energy.

It has been found that due to the low heat content of process gas, the amount of air required for combustors is not large enough to cool and maintain safe wall temperatures at the combustor's respective primary and secondary combustion zone enclosures by conventional cooling methods.

Various combustors for use with gas turbine systems are disclosed in U.S. Pat. Nos. 3,738,106, 3,720,497; 3,608,309; and 3,589,128. In the combustors disclosed in these patents, compressed air is passed about the combustion chamber in a direction counter to the direction of flow of the combustion gases therein, primarily for the purpose of cooling the inner liner or wall about the combustion zone before the air is delivered for mixture with the fuel to be delivered and burned in the combustion chamber. This type of counter flow operation, provides film cooling of the combustion zone wall, but cannot meet the cooling requirements necessary to burn low heat content gaseous fuels.

One of the problems encountered in the development of a combustor to burn low heat content gas was the inability of lean, low heat content gas-air mixtures to ignite and burn stably in the combustor during start-up. However, once the start-up phase has passed, combustion of the low heat content gas-air mixtures proceed satisfactorily to provide good gas turbine performance.

To overcome the start-up phase ignition problems, use of another fuel has been considered. While the volume of liquid fuel is drastically lower compared to the gaseous fuel, and its heat content per mass unit is higher, nonetheless a liquid fuel was found to be compatible with, not only the start-up phase ignition, but also with a switchover function to low heat content gaseous fuel. Use of the liquid fuel minimizes the danger of combustor flame-out or prohibitive instability which may occur when attempting start-up with the low heating content gaseous fuel. Accordingly, a combustor having a multi fuel operating capability will provide enhanced performance because at normal load conditions, it will be capable of burning low heat content gases.

A combustor for use with a gas turbine is disclosed in U.S. Pat. No. 2,648,950 which may burn a gaseous fuel injected into the primary combustion zone of the chamber and also a pulverized liquid fuel injected into the secondary combustion zone of the combustion chamber after the evaporation of the water component thereof is completed. These different fuels are injected into the combustion chamber, not only in different zones thereof, but oriented so that the nozzles oppose each other. This type of structural arrangement however does not meet or overcome the problems of ignition start-up using a low heat content gaseous fuel. Therefore, reliance upon the apparatus disclosed in this patent could not provide the particular structural arrangement which would allow the alternate burning, and selective switching, of gaseous and liquid fuels.

With the need for new sources of energy; the development of more feasible techniques for economically utilizing heretofore uneconomical forms of energy such as low heat content gases produced in shale oil extraction processes has become increasingly more attractive providing a suitable apparatus can satisfactorily burn this type of gas.

To achieve such a satisfactory combustor, the parameters desired include, the employment of alternate fuel burning capabilities to ensure good start-up performance; convenient switchover; providing controls to switchover from the liquid fuel burning mode at start-up to the gaseous fuel burning mode at normal load operations including, providing the proper amounts of air for optimum fuel mixture burning; minimizing movable or operable parts to provide the switchover ability; providing the necessary cooling requirements for both liquid burning fuel start-up and gaseous burning fuel normal mode especially for keeping the wall temperatures of the combustors primary and secondary zones within safe limits.

The present invention provides an improved combustor which can satisfy these requirements.

SUMMARY OF THE INVENTION

Thus the present invention covers an improved counter-flow combustor which includes, a hollow outer casing having a closure means at one end forming a head spce, and a hollow inner casing mounted in and spaced from the outer casing to form an annular space therebetween in communication with the head space, said inner spacing defining a combustion chamber having a primary combustion zone, a secondary combustion zone, and a discharge outlet for the combustion gases, an inlet assembly disposed in the head spce for injecting a mixture of air and fuel into the primary combustion zone and secondary combustion zone for combustion therein, and the combustion therewith of an air passage inlet remote from the inlet assembly, and a plurality of cooling tubes mounted on the inner wall of the inner casing connected to the air passage inlet for receiving air to cool the wall of the inner casing and to pass the same to the inlet assembly for mixture with fuel to be passed to the primary combustion zone and secondary combustion zone counter to the direction of flow of the combustion gases passing through the combustion chamber to the discharge outlet for the combustor.

Additionally, a counter-flow combustor capable of alternatively and selectively burning liquid fuels and gaseous fuels including low heat content gaseous fuels wherein the inlet assembly includes, a swirler nozzle concentric to the longitudinal line of the combustor with a liquid fuel inlet nozzle in the longitudinal line of the combustor, and gaseous fuel inlet means extending through the outer shell and in communication with the swirler nozzle of the inlet assembly, and control means to alternatively and selectively regulate the inflow of gaseous fuel or liquid fuel for mixture with air to provide the proper mixture for combustion in the primary combustion zone of the combustor.

Further, the combustor capable of alternately burning liquid fuels and gaseous fuels including low heat content gaseous fuels as above described including by-pass means for by-passing a portion of the air delivered to the combustor for mixture with the selected fuel, injector nozzles for injecting additional air in the secondary combustion zone when the combustor is operated on liquid fuel, and actuating means connected to the injector nozzles for selectively moving the same from open to closed position and vice-versa as a function of the selected fuel being utilized.

Additionally the combination of any one of the combustors for alternately and selectively burning liquid fuels and gaseous fuels including low heat content gaseous fuels as respectively above described with a gas turbine-compressor system wherein the compressor provides compressed air for the fuel combustor and the turbine receives combustion gases from the outlet of the combustor for driving the turbine.

Accordingly, it is an object of the present invention to provide a counter-flow combustor for providing combustion gases which includes means for cooling the inner wall of the combustion chamber which is operatively associated with a source of air to ensure safe wall temperatures for the walls of the respective primary and secondary combustion zones in the combustor.

It is another object of the present invention to provide an improved counter-flow combustor which allows for the alternate and selective burning of liquid and gaseous fuels including low heat content gaseous fuels, the liquid fuel being utilized for the start-up operation of the combustor and the gaseous fuels being utilized during normal load phase operation and including controls to provide for the switching between liquid and gaseous fuels and for the delivery of additional dilution air into the operative combustion zone of the combustor during the liquid fuel burning mode.

It is still a further object of the present invention to provide a counter-flow multi-fuel combustor which has a minimal number of movable or operable components in order to achieve the switchover from liquid fuel to gaseous fuel, which components are conveniently mounted on the exterior of the combustor and are therefore accessible for service and maintenance if required.

It is still a further object of the present invention to provide a counter-flow combustor adapted for duel fuel operation which includes cooling tubes mounted on the inner wall of the combustion chamber or at least the primary combustion zone thereof which cooling tubes are provided with a mounting arrangement which permits them to be individually removed for inspection, repair and/or replacement and which advantageously allows for expansion and contraction of the individual tubes during combustor operation in order to minimize thermally induced cooling tube wall stresses; said mounting means adaptable not only for support but to prevent excessive random disarrangement and excessive mechanical stresses in the tubes during operation of the combustor.

Other objects and advantages of the combustors in accordance with the present arrangement and in their respective combination with a gas turbine-compressor system wil become apparent from the following description of the invention taken with the drawings in which.

Figure 5:
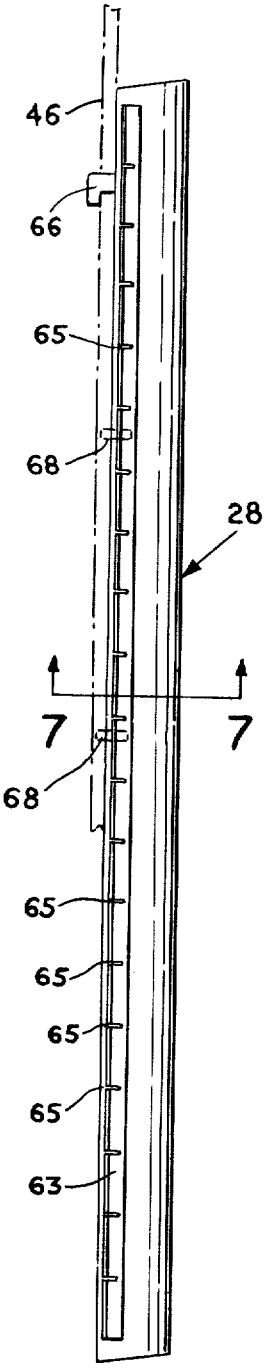
FIG. 5 is a side view of a cooling tube for the combustor illustrated in FIGS. 1 to 4 of the drawings.
Figure 5A:
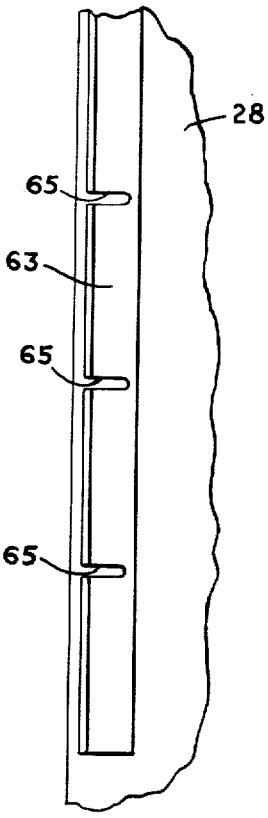

FIG. 5*a* is an enlarged fragmentary view of a cooling fin for the cooling tubes for the combustor illustrated in FIGS. 1 to 4 of the drawings.

Figure 6:
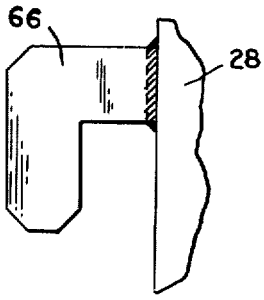

FIG. 6 shows a preferred form of hook for holding the cooling tubes for the combustor illustrated in FIGS. 1 to 4 of the drawings.

Figure 7:
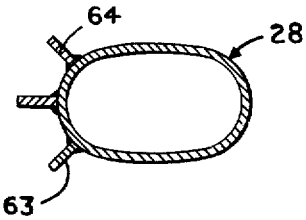

FIG. 7 is an enlarged cross-section taken on line 7—7 of FIG. 5.

Figure 8:
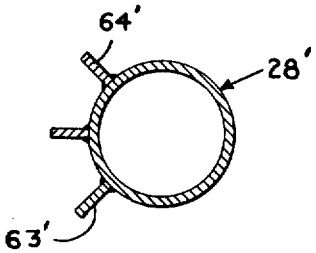

FIG. 8 is an enlarged cross-sectional view of an alternate form of cooling tube for the combustor illustrated in FIGS. 1 to 4 of the drawings.

Figure 9:
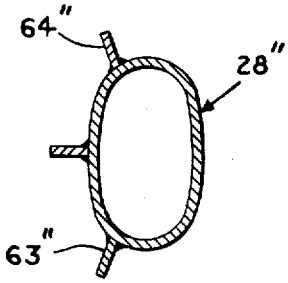

FIG. 9 is an enlarged cross-sectional view of another alternate form of cooling tube for the combustor illustrated in FIGS. 1 to 4 of the drawings.

Figure 10:
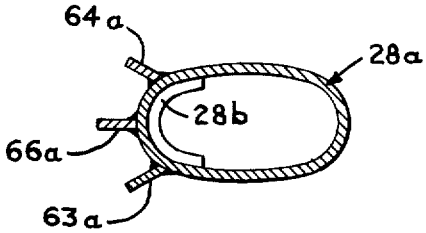

FIG. 10 is an enlarged cross-sectional view of still another alternate form of cooling tube with a heat shield therein for the combustor illustrated in FIGS. 1 to 4 of the drawings.

Figure 3:
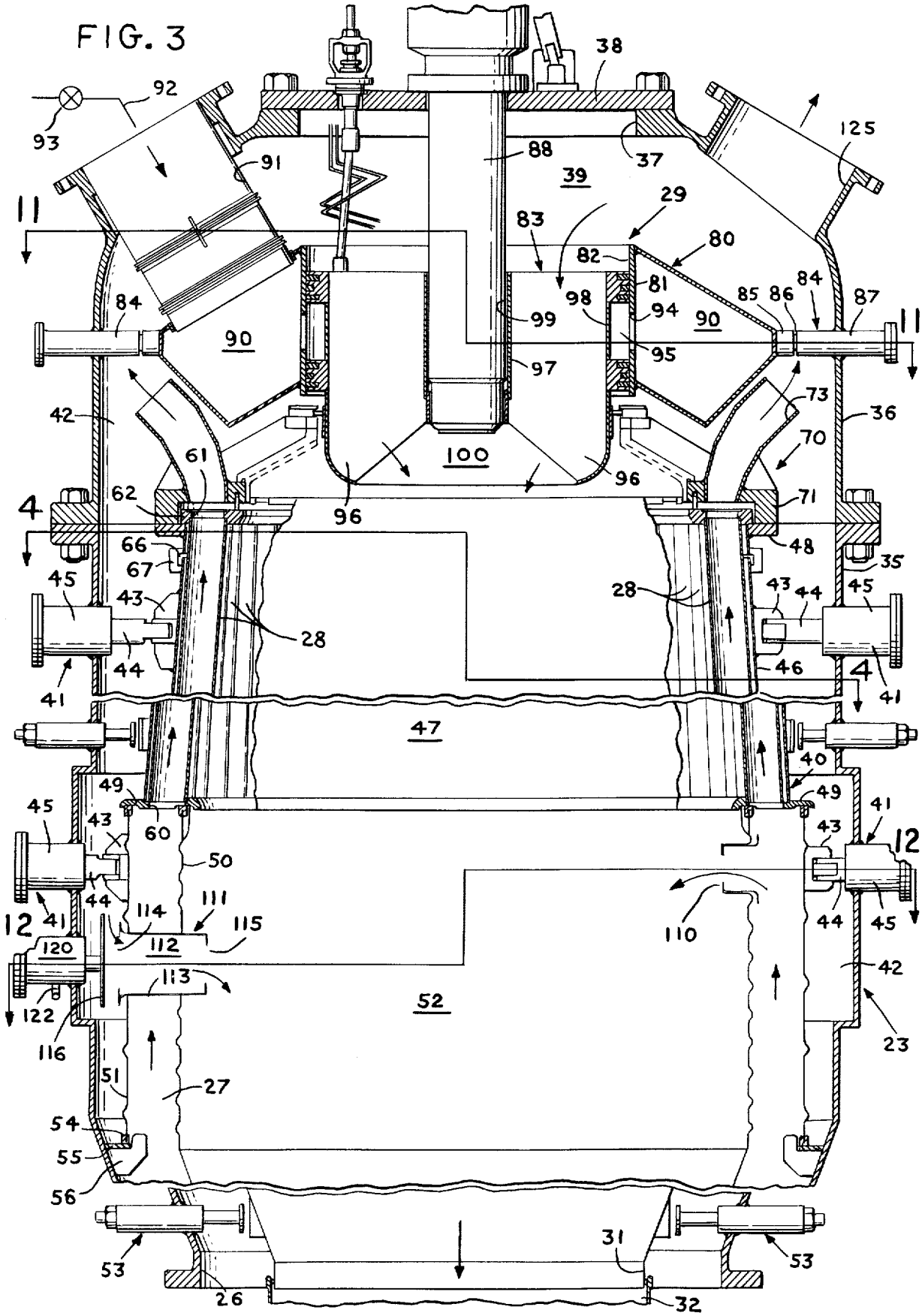
FIG. 3 is a vertical section taken on line 3—3 of FIG. 2.
Figure 4:
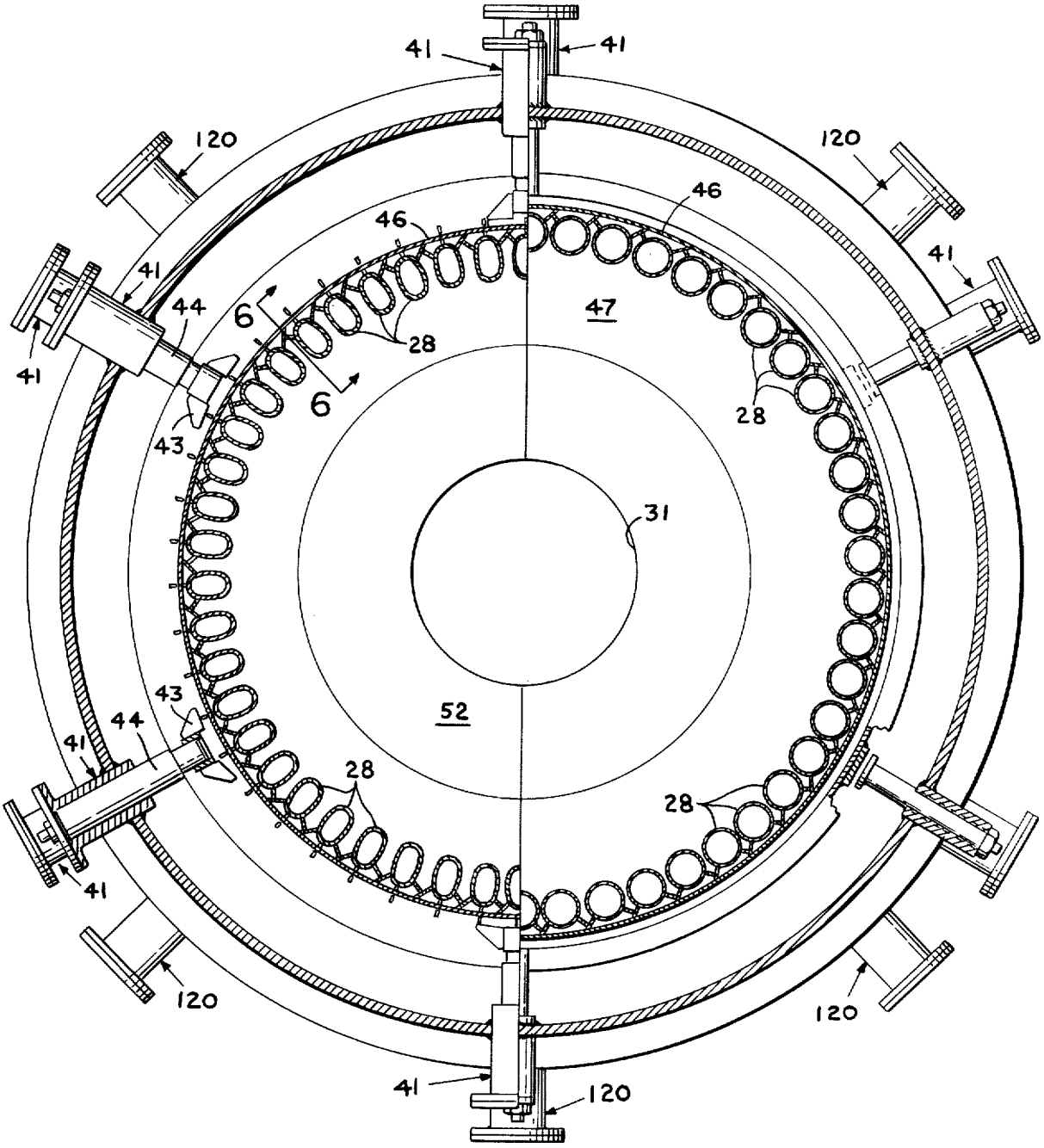
FIG. 4 is a cross-section taken on line 4—4 of FIG. 3.
Figure 11:
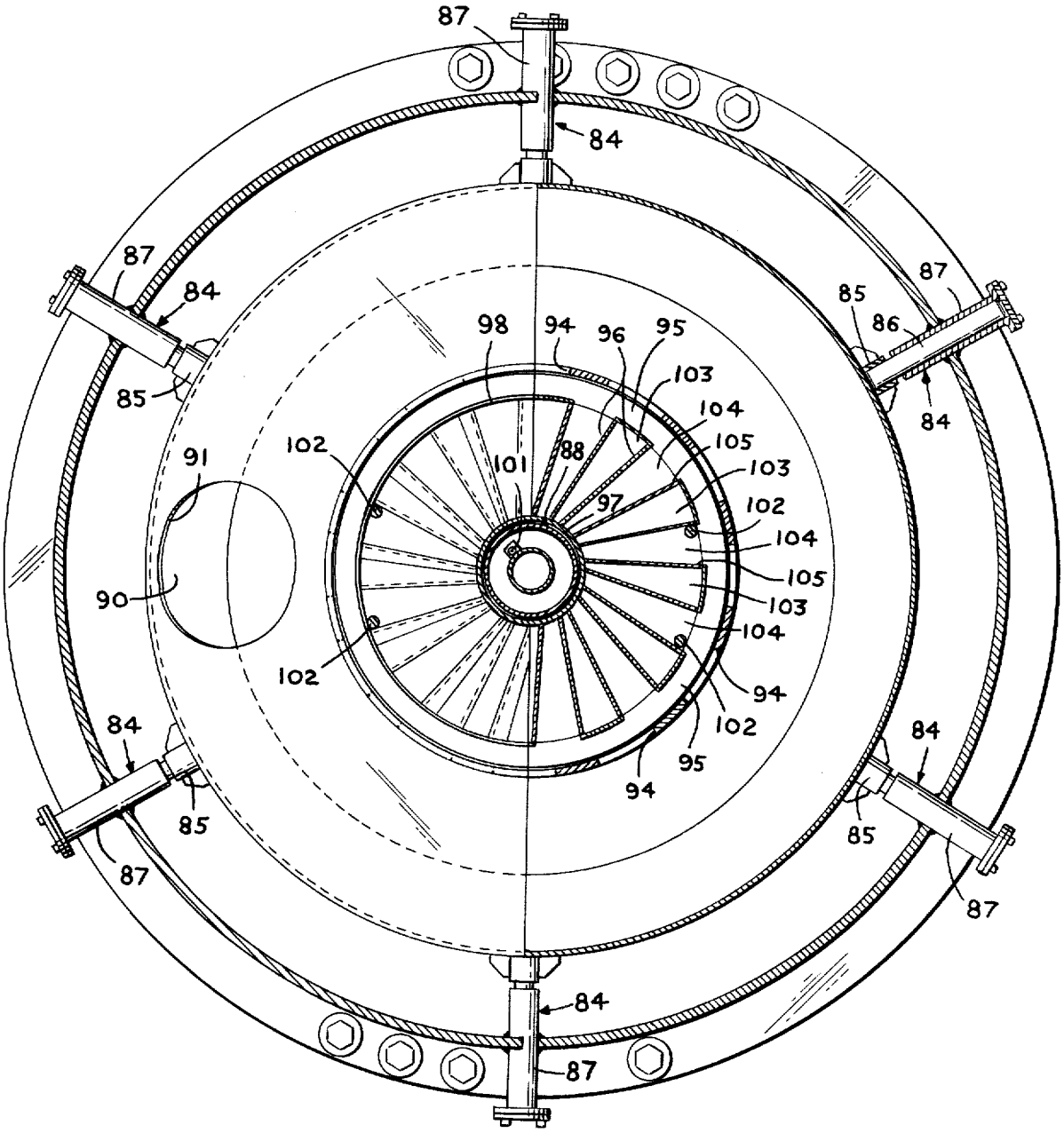

FIG. 11 is a cross-section taken along line 11—11 of FIG. 3.

Figure 12:
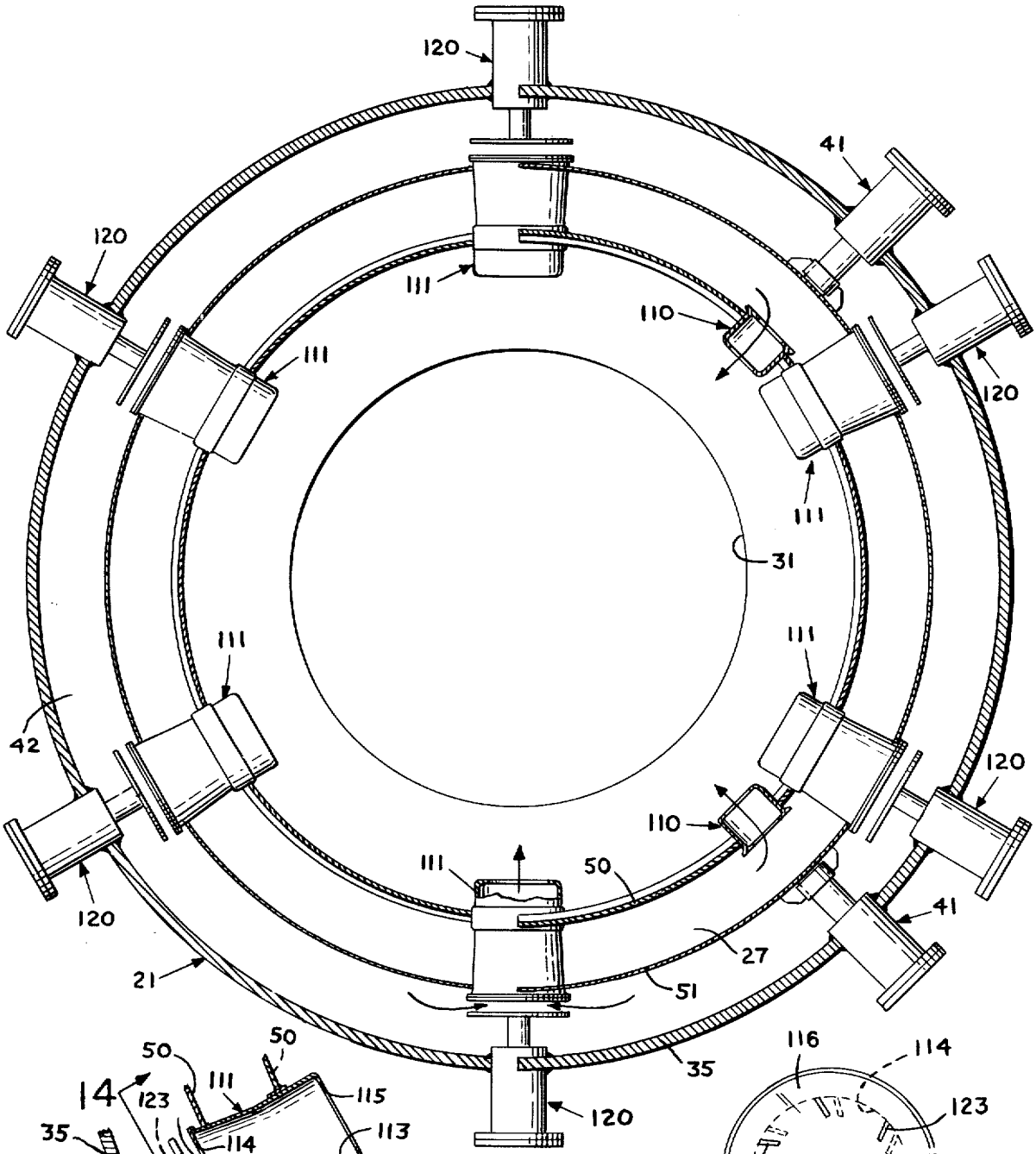

FIG. 12 is a cross-section taken along line 12—12 of FIG. 3.

Figure 13:
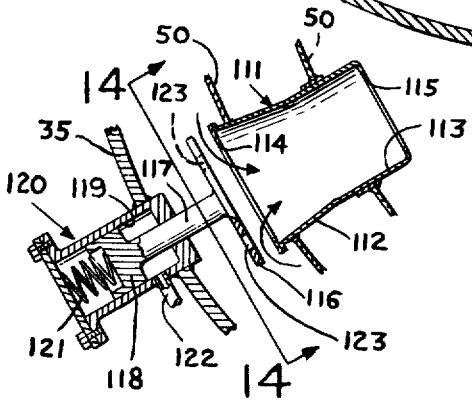

FIG. 13 is a horizontal section through one of the operable injector valves shown in FIG. 12.

Figure 14:
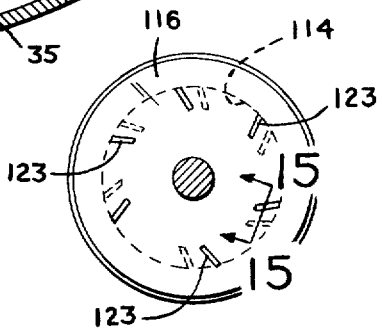

FIG. 14 is a cross-section taken on line 14—14 of FIG. 13.

Figure 15:
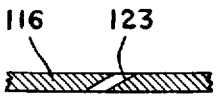

FIG. 15 is a cross-sectional view taken along line 15—15 of FIG. 14.

DETAILED DESCRIPTION

Figure 1:
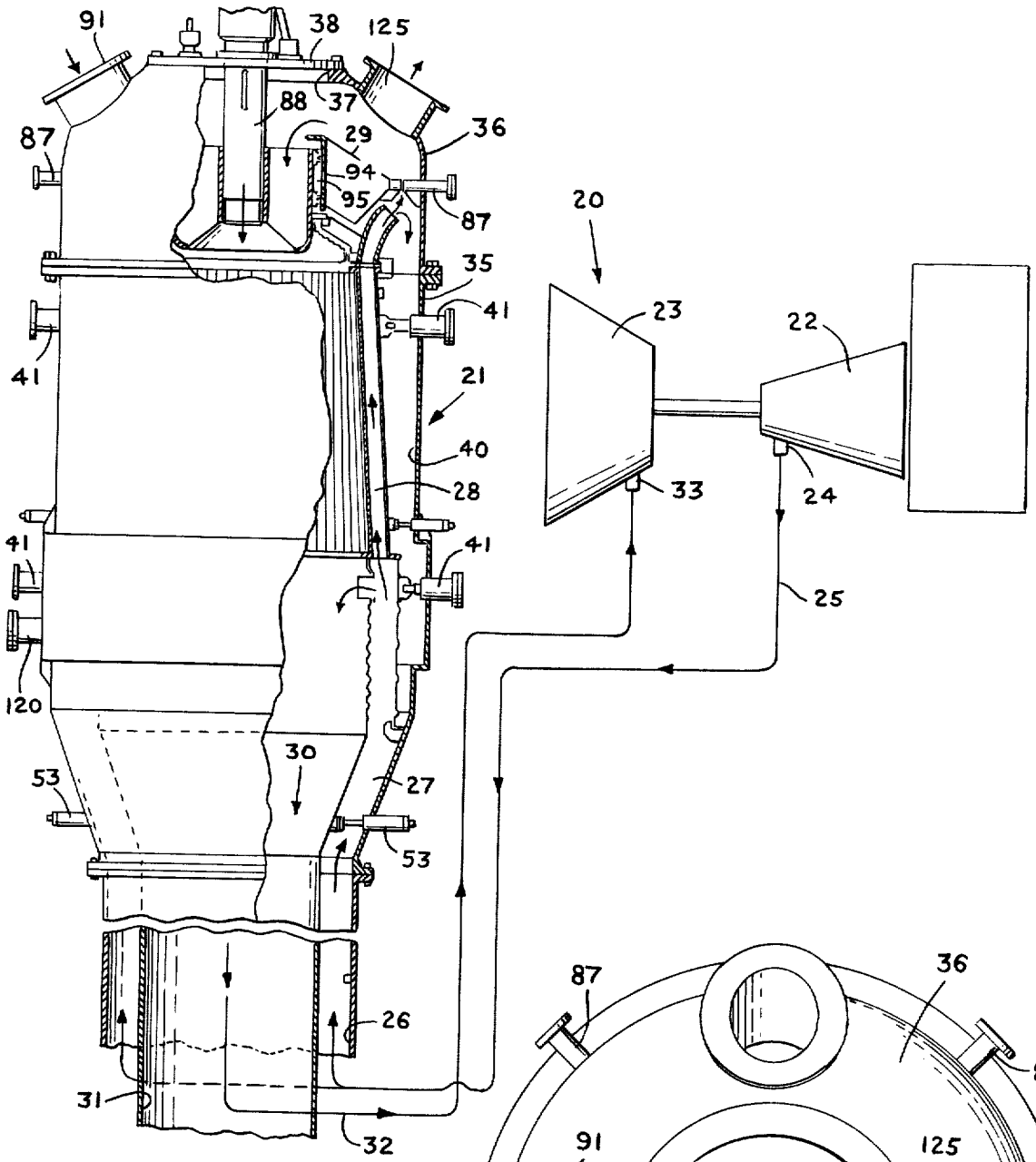
FIG. 1 is a schematic illustration of a gas turbine-compressor system for driving a generator having an improved combustor in accordance with the present invention.

Referring to the drawings FIG. 1 illustrates schematically a gas turbine-compressor system generally designated 20 operatively associated with a counter-flow combustion chamber or combustor 21 in accordance with the present invention.

Gas turbine-compressor systems in combination with combustion chambers or combustors for supplying combustion gases for driving the gas turbine are well known types of systems and are utilized for a variety of purposes including the driving of an electric generator for generating electrical energy as will be understood by those skilled in the art.

Thus, the gas turbine-compressor system 20 includes a compressor 22 which is driven by a gas turbine 23. The compressor 22 draws air in and discharges the same through discharge outlet 24 and line 25 to the air inlet 26 for the combustor 21. Air inlet 26 communicates with an air passage 27 connected to a plurality of circumferentially spaced cooling tubes 28 more fully described hereinafter which in turn communicate with an inlet assembly 29 for delivering a mixture of air and fuel to the combustion chamber 30 in the combustor 21 where the same is ignited and burned to deliver combustion gases through the discharge outlet 31 which communicates by line 32 with the inlet 33 for gas turbine 23. Where the combustion gases expand and drive the turbine 23 all of which will be understood by those skilled in the art.

COMBUSTION CHAMBER OR COMBUSTOR

Referring now to FIGS. 2 to 15 of the drawings, the combustion chamber or combustor 21 in accordance with the present invention utilized with the above described gas turbine-compressor system 20 includes an elongated hollow cylindrical outer casing or shell 35 which by reason of the construction of the combustor as is more fully described hereinafter maybe fabricated or cast from conventional metal alloys. The outer casing or shell 35 is closed at its upper end by a head or closure member 36 having an access opening 37 closed by access plate 38. The closure member 36 defines a head space 39 and the inlet assembly 29 is diposed in the head space and is accessible for maintenance and repair through the access opening 37 when the access cover plate 38 is removed.

Operatively associated with the outer casing or shell 35 is an inner casing or combustion wall 40.

The inner casing or combustion wall 40 like the outer casing 35 is an elongated hollow cylindrical member having a diameter less than the inner diameter of the outer casing. Thus when the inner casing 40 is mounted within the outer casing 35 by means of the plurality of circumferentially and vertically spaced supporting and spacing brackets all generally designated 41, the outer casing 35 and inner casing 40 will define an annular head space extension 42 so that air discharged into the head space 39 as is more fully described below will also pass downwardly and into and fill the head space 42 for use in connection with the operation of the combustor 21 on liquid fuel.

Each of the supporting and spacing brackets 41 include an inner connector 43 mounted on the outside of the inner casing 40 and an adjustable connector 44 which is mounted on and adjustable through a supporting and spacing bracket housing 45 connected in the wall of the outer casing 35.

Inner casing 40 has an annular tapered upper wall enclosure 46 which defines a primary combustion zone 47. Primary combustion zone 47 communicates at its upper end with the inlet assembly 29. A radially outward extending flange 48 is connected about the upper end of the annular tapered upper wall enclosure 46 and a flexible radially disposed seal ring 49 is operatively associated with the lower end of the tapered upper wall 46. The upper annular wall section 46 of the inner casing 40 can be made of conventional steel alloys because of the structure and operation of the combustor 23 as will also be more fully described hereinafter.

The tapered upper wall enclosure 46 supports the cooling tubes 28 which may have either elliptical or oval shapes and compressed air as abive described will be delivered through an inlet 26 and air flow passage 27 to the cooling tubes 28, then to the top cavity or head space 42, and then into the inlet assembly 29 this air is mixed with either liquid or gaseous fuel depending on the operating mode for combustor operation then in use and passed to the primary combustion zone 47. During all times that compressed inlet air is fed into the annular air flow passage 27, some portion of said air will be metered through metering nozzles 110 into the secondary comustion zone 52 for reasons and purposes that will be made clear and more fully described below.

Connected to the lower flexible seal ring 49 in spaced relation are a lower annular inner wall sections 50 and a lower intermediate wall section 51 which define therebetween and with the outer casing 35 the air inlet 26 and air flow passage 27 for the air delivered from the compressor 22 as above described. Annular lower inner wall 50 defines therin the secondary combustion zone 52 which communicates at one end with the primary combustion zone 47 and at the end remote therefrom with the discharge outlet 31 for delivering combustion gases to the connecting line 32 and inlet 33 for the turbine all of which is shown in FIGS. 1 and 3 of the drawings.

FIG. 3 further shows that the lower most end of the inner wall section 50 is supported in spaced relation to the outer casing 35 by a plurality of circumferentially disposed inner wall section adjustable, supporting and spacing brackets 53. The lower most end of the intermediate wall section 51 which is shorter than the inner wall section 50 has an annular rim 54 which engages and rests on an annular radially inward extending ring 55 mounted in spaced annular ring supporting brackets 56.

The inner wall section 50 and intermediate wall section 51 will be made of high heat resistant steel alloys or other metal alloys which are able to withstand the temperatures of the combustion gases which expand from the primary zone 47 and undergo further combustion in the secondary combustion zone 52 in the inner casing 40.

Lower flange 49 about the upper combustion wall section 46 is provided with a plurality of circumferentially spaced openings 60 shaped so that the lower end of the plurality of open ended cooling tubes 28 will fit therein to permit air flowing through the air passage 27 to pass into the cooling tubes 28. The upper end of the respective plurality of cooling tubes 28 fit into a plurality of circumferentially spaced openings 61 in an annular cooling tube supporting ring 62 which as shown in FIG. 3 in assembled position rests on the inner edge of the radially outward extending flange 48 at the upper end of the upper wall section 46.

FIGS. 3, 4, 5, 6 and 7 show that the plurality of open ended cooling tubes 28 are circumferentially disposed on the inner surface of the tapered upper wall section 46 and in this position surround the primary combustion zone 47 to provide a convective cooling enclosure to absorb as much heat as possible so as to permit the use of conventional metal alloys and thus reduce the overall cost of the manufacture of the combustor 21.

In order to further facilitate and increase the cooling effect by the cooling tubes 28 and to facilitate their removal and repair, the cooling tubes are specially constructed as shown in FIGS. 4 to 10 of the drawings.

Thus cooling tubes 28 which are made of conventional high temperature metal alloys able to withstand the heat of combustion under the conditions of the present construction are elongated members which may be eliptical in cross-section as shown in FIG. 7, round in cross-section as shown in FIG. 8 or oval in cross-section as shown in FIG. 9 in order to permit assembly thereof on the inner face of the tapered or conical inner wall enclosure 46. This construction permits the cooling tubes 28 to be mounted in such a manner that convection and radiation heat from the primary combustion zone 47 can leak around the tubes 28 to the wall side formed by the upper wall section 46. Further in whatever shape the cooling tubes 28 is constructed there will be added spaced cooling fins as at 63 and 64 as on the eliptically shaped tubes 28, 63′ and 64′ on the round cooling tubes 28′ and 63″ and 64″ on the oval shaped tubes 28″. The respective fins on each tube are oriented in overlapping relationship with the fins of the next adjacent tube to prevent direct exposure of the inner surface of the upper wall section 46 to radiant heat from the primary combustion zone.

To avoid stress due to differential thermal expansion between the walls of the respective cooling tubes 28 and the cooling fins connected thereon, each of the fins 63 and 64 will be sloted transversely at two to three inch (5.1 to 7.6 c.m.) intervals along the longitudinal length thereof as shown at 65 in FIGS. 5 and 5*a* of the drawings.

Referring further to FIGS. 3, 4, 5 and 6 of the drawings, it will be seen that the respective cooling tubes 28 are also supported on the upper wall section 46 of the inner casing 40 by a hook 66 which fits into a slot 67 on the upper wall section 46 and the tubes 28 are guided along their length by a series of pins 68 which hook to the inner combustion wall in such a manner that the respective cooling tubes 28 can move to minimize thermal stresses but cannot become randomly disarranged due to buckling or unevan heating thereof so as to damage or interfere with the adjacent cooling tubes.

The anchoring system for the cooling tubes 28 acts to relieve unnecessary high stresses which a restrained fasting means would cause. The individual tubes are guided over their entire length by this suspension system which allows free but guided expansion when the cooling tubes 28 receive heat from the primary combustion zone 47 during operation of the combustor 21. While the suspension system permits considerable freedom for bowing of the cooling tubes, it is also designed to prevent disorderly tube arrangement which may occur after repeated systems starts and stops. Additionally the adjustable support and spacing brackets 41 for the inner casing 40 cooperate with the suspension system for the cooling tubes to reduce susceptibility to vibrations induced by the process of combustion in the combustor 21 because they act as dampers to prevent critical cooling tube frequencies or oscillations within the operating range of the combustors noice spectrum.

Lastly, the suspension system allows individual replacement of tubes which may become damaged during the operation of the combustor 21.

Those skilled in the art will understand that in addition to considerations of combustion wall cooling, thermal stresses and tube configuration, other factors including air flow requirements and pressure drops in the combustor, and more particularly in the cooling tubes, affect the overall design parameters of the type of cooling tube enclosure which is provided. A delicate balance has to be struck between pressure drop of the cooling air inside the cooling tubes and tolerable metal temperatures of the tube walls.

The air flow parameters are selected in such a manner that as much cooling air as possible is made available for flow through the cooling tubes 28 and about the primary combustion zone in order to assure better than adequate cooling of all heat exposed components of the combustor by convection alone, thereby enhancing reliability of system base load operation and combustor life. A typical combustor may have the following parameters:

| | |
|---|---|
| overall combustion chamber length | 187" (475 cm.) |
| length of primary combustion zone | 89" (226 cm.) |
| mean diam. of primary comb. zone | 77" (196 cm.) |
| ref. air vel. in prim. comb. zone | 77.5 ft. per second (23.6 m./sec) |

-continued

| | |
|---|---|
| aver. inner comb. wall temp. | 1,000° F. (536° C.) |
| air flow area | 942 ft.$^2$ (87.6 m$^2$) |

With these and other parameters, not mentioned, typically found in the combustor, the following parameters of the respective cooling tubes have been found compatible:

| | |
|---|---|
| elliptical tubing, major axis | 5.1" (13 cm.) |
| elliptical tube, minor axis | 4.3" (11 cm.) |
| wall thickness | 0.12" (0.3 cm.) |
| tube length | 83" (210 cm.) |
| no. of cooling tubes | 51 |

In order to minimize thermal stresses in the walls of the cooling tubes 28 and to avoid excessive bending about the longitudinal axis of the cooling tubes, it is desirable to maintain a low mean temperature difference between the portion of the walls of the cooling tubes facing the primary combustion zone 47 and the portion of the cooling tubes facing the inside surface of the upper wall section 46. This is accomplished in the disclosed embodiment above described by judicious selection of spacing between the respective cooling tubes by the predetermined spaced relation, the suspension system maintains the respective cooling tubes from the inner surface of the upper wall section 46, and by the size and thickness of the cooling fins provided on the respective cooling tubes. Further the gaps provided by the slots 65 on the cooling fins permit the hot combustion gases to leak in a controlled fashion into the space between the remote side of the respective cooling tubes and the inner surface of the upper wall section 46 so as to increase the rear or remote wall temperatures of the respective cooling tubes 28 to levels just high enough to be safe for the inner surface of the upper wall section 46.

It has been found however that the addition of a thermal barrier either inside or outside the cooling tube wall facing the inner combustion zone will assist in maintaining this low mean temperature difference and an alternate cooling tube 28*a* having this construction is illustrated in FIG. 10.

Thus by reference to FIG. 10, the cooling tube 28*a* is similar to cooling tube 28 as above described and therefore includes the spaced paired fins 63*a* and 64*a* and the mounting hood 66*a*. Further however a heat shield 28*b* is inserted inside the tube 28*a* around the portion of the cooling tube 28*a* adjacent the inner wall of the upper wall section 46 in assembled position so that the heat shield faces the primary combustion zone 47 when the cooling tube 28*a* is in assembled position.

Heat shield 28*b* is preferably a low conductivity coating or material which will improve the period of usefullness of the cooling tubes 28*a* and since this cooling tube 28*a* is in all respects similar to cooling tube 28 it is mounted in the same fashion on the inner surface of the upper wall section 46 as has been above described.

The cooling tubes 28 coact with an air diffuser generally designated 70. Thus air used for convective heat transfer in the respective cooling tubes 28 will pass from the cooling tubes to the diffuser 70 wherein a substantial percentage of the dynamic head pressure of the air flowing through the diffuser will be recovered.

Recovery of dynamic head pressure in the air flowing through the diffuser 70 is desirable because of the pressure losses which occur in the air flowing through the respective cooling tubes 28 due to friction and heating as satisfactory convection heat transfer by the respective cooling tubes 28 requires certain cooling air velocities with corresponding friction pressure losses which tax the allowable overall pressure drop limits in the flow passages and cavities in the system between the compressor discharge and the inlet to the turbine.

Diffuser 70 as shown in FIG. 3 of the drawings includes an annular fastening ring 71 which is L-shaped in cross-section so that in assembled position it can overlay the annular connector 62 at the upper end of the plurality of cooling tubes 28 and be connected to the outer portion of the upper flange 48 on the upper wall section 46.

Extending upwardly from the medial section of the annular fastening ring 71, an annular scroll shaped outlet 73 is formed so that the inlet end thereof is in alignment with the discharge end of the plurality of cooling tubes 28 and the outlet end communicates and discharges air into the head space 39 at a point outboard of the inlet assembly 29 so that the discharging air will be free to pass into the inlet assembly 29 and nozzle 112, when the combustor is in the liquid fuel mode, as is clearly shown in FIG. 3 of the drawings.

Accordingly, the compressed air which enters through inlet 26 passes through the flow passage 27, the respective cooling tubes 28 and the scroll shaped outlet 73 to the head space 39.

However because of the curved character of the scroll shaped element 73, the compressed air will be turned and diffused so that a portion of the velocity will be converted into pressure thus recovering a portion of the head pressure lost due to friction in passing from the inlet 26 through the outlet of the scroll shaped element 73 to the head space 39.

The structure as presently described is adaptable for use in a combustor which is designed to burn liquid fuel or one that is designed to burn gaseous fuel including gaseous fuel with low heat content. However, the present invention applies the above described structure to a combustor capable of burning alternately and selectively liquid fuel or gaseous fuel including gaseous fuel having a low heat content and the different features and components for accomplishing this desirable end will now be described in more detail.

Accordingly referring now to FIGS. 3 and 11 the inlet assembly 29 provides the structure for intimately mixing in proper ratio the air with either liquid fuel sprayed into the primary combustion zone 47 or gaseous fuel passed therethrough into the primary combustion zone.

The inlet assembly 29 includes an annular hollow doughnut shaped outer element 80. The inner wall 81 forms a center opening 82 and concentrically supported housed and sealed on the inner wall so that it lies in said center opening 82 is an air swirler assembly 83. Circumferentially spaced radially inward extending inlet assembly supporting brackets 84 are connected in the wall of the closure member 36 so that they extend into the head space to support the inlet assembly 29 therein by engagement with the doughnut shaped outer element 80. Each of the inlet assembly support brackets 84 respectively including, a female connector 85 on the outer periphery of the donut shaped outer element 80, and a male rod connector 86 which extends through an inlet assembly bracket housing 87 in the wall of the closure member 36. The male rod connector 86 is accessible from the exterior of the combustor and by means thereof, the inlet assembly and operatively associated air swirler will be mounted in the head space concentric to the vertical axis of the combustor 21 for the operative association with the primary combustion zone 47 all of which is shown in FIGS. 3 and 11 of the drawings.

FIGS. 3 and 11 further show that an elongated liquid fuel nozzle 88 is connected to the access plate 38 so that it lies and extends into the head space 39 in the vertical axis of the combustor so that it lies within the air swirler 83 to permit liquid fuel to be mixed with the air and possibly some gaseous fuel during the transition from gaseous fuel, liquid to liquid fuel mode of operation discharging from the air swirler 83 into the primary combustion zone 47.

FIGS. 3 and 11 further show that the annular hollow donut shaped outer element 80 defines an annular gas supply chamber 90 and connected to the doughnut shaped outer element 80 is a gas fuel supply conduit 91 which extends through the closure member 36 for communication with a gas supply line 92 having a control valve 93 therein to control delivery of the gaseous fuel through line 92 and conduit 91 to the gas supply chamber 90 of the inlet assembly 29. The inner wall 81 of the doughnut shaped outer element 80 is further provided with a plurality of circumferentially disposed openings 94 which communicate with an annular manifold 95 formed about the outer periphery of the air swirler 83 so that gaseous fuel when delivered to the gas supply chamber 90 can pass freely from the gas supply chamber 90 through the openings 94 and the manifold 95 into the air swirler 83 for initmate mixture with combustion air being delivered therethrough as will now be described.

The air swirler 83 has a plurality of hollow angled vanes 96 connected to an inner shroud 97 and an outer shroud 98. The inner shroud 97 forms the space or opening 99 through which the liquid fuel injector nozzle 88 extends. The upper or inlet end of the vane 96 are preferably perpendicular to the vertical access of the combustor 21, the lower ends however are angled so that the inner ends are connected to the inner shroud 97 at the point where the liquid fuel injector nozzle ends so that they define an ignition space or chamber 100 which opens and communicates directly with the primary combustion chamber 47 all of which is clearly shown in FIG. 3 of the drawings.

In order to initiate ignition the liquid fuel injector nozzle 88 is operatively associated with a liquid fuel ignition means 101, which is like a special type of conventional automobile sparkplug.

In FIGS. 3 and 11 the hollow vanes 96 are shown as paired together and assembled so they define circumferentially and alternately air flow passages as at 103 and gas fuel flow passages as at 104. The air flow passages 103 communicate at their inlet ends with the head space 39 and at their exit or outlet end with the ignition space or chamber 100. The gas fuel flow passages are closed at their upper end and are provided with side inlets as at 103 which communicate with the gas fuel manifold 95 and at their exit or outlet ends similar to the air flow passages communicate with the ignition space or chamber 100.

Thus the combustion air which is preheated by reason of the flow through the cooling tubes 28 when delivered to the head space 39 will flow into the inlet end of the air flow passages 103 in the air swirler 83 and pass therethrough to the ignition space or chamber 100.

If the combustor is operating on liquid fuel then the liquid fuel is injected in a predetermined quantity from the liquid fuel injecting nozzle 88 into the ignition space or chamber 100 where it is mixed with the air delivered by the air swirler and ignited by the liquid fuel ignition means 101. The ignited mixture of liquid fuel and air will then expand due to combustion of the mixture due to the primary combustion zone 47 and secondary combustion zone 52 where combustion continues. It will be understood by those skilled in the art that the combustion of the liquid fueld air mixture will be further controlled in the secondary combustion zone by diverting an additional portion of the combustion air into the secondary combustion zone by means and for purposes which will be more fully described below.

If the combustor is operating on gaseous fuel, the gaseous fuel passing from the gas collecting chamber 90, openings 94 and gaseous fuel manifold 95 into the gaseous fuel flow passages 104 passes downwardly and exits from the outlet of the passages 104 into the ignition space or chamber 100 where in proper proportion with the air delivered will mix and be ignited by the existing combustion of the liquid fuel air mixture in the primary combustion zone 47. After stable combustion is achieved the burning mixture of gaseous fuel and air will expand into the primary combustion zone 74 and secondary combustion zone 52 where combustion continues to provide the combustion gases for exhaust through the outlet 31 and delivery through line 32 to the gas turbine. Delivery of liquid fuel through nozzle 88 is terminated as soon as stable combustion with low heat content gaseous fuel is achieved.

COMBUSTION AIR CONTROL

While the inlet assembly 29 above described provides one preferred means for delivering either liquid fuel or gaseous fuel including gaseous fuel with low heat content, those skilled in the art will recognize that in order to utilize the advantages of a combustor of this type that at least two factors must be taken into account. First, inasmuch as the volume of the liquid fuel is considerably smaller than that of the gaseous fuel and its heat content per mass unit higher that to maintain flame stability in the primary combustion zone 47 and a proper temperature profile control therein that considerably more air must be delivered into the secondary combustion zone 52 when the combustor is operated in the liquid fuel burning mode. Second, because of the difficulties of igniting a low heat content gaseous fuel-air mixture with a satisfactory degree of burning stability during start-up of the combustor, it is desirable that the operation of the combustor be instituted with a start-up phase in the liquid fuel burning mode and thereafter at a predetermined operating point, the combustor can be switched over by transition from a dual mode, i.e. liquid fuel and low heat content gas/air mixture, to a gaseous fuel burning mode. In the present embodiment being described, taking all pertinent factors into consideration, liquid fuel will be used until approximately a 60% load level is reached i.e., at 100% of the design speed level for the given turbine.

In order to meeth these factors so as to provide a combustor capable of operating in both the liquid fuel burning mode and the gaseous fuel burning mode, means are provided to adjust the various air flow requirements to the secondary combustion zone 52 in the combustor to permit transition from one burning mode to the other.

Accordingly, referring to FIG. 3 and FIGS. 12 to 15 of the drawings, a plurality, for example at least three circumferentially spaced bleed orifices 110 are provided in the upper end of the inner lower wall section 50 at a point in the secondary combustion zone 52 adjacent the primary combustion zone 47 to meter a predetermined quantity of combustion air during all times that the combustor 21 is in operation in the order of 15 to 20% from the combustion air passage 27 into the secondary combustion zone 52. The quantity of combustion air so by-passed through orifices 110 is provided to initiate primary combustion zone recirculation which is required for stable combustion and to insure good gas mixing, the result of which will be to provide an acceptable temperature profile for the combustion gases delivered to the turbine nozzles.

In addition to the combustion air delivered through the bleed orifices 110, a plurality of circumferentially spaced injector nozzles 111 are connected to extend through the respective intermediate lower wall section 51 and inner lower wall section 50 so as to provide a flow passage for passing heated combustion air from the head cavity extension space 42 into the secondary combustion zone 52 whenever the injector nozzles are moved to open position. As above indicated the injector nozzle 111 will be moved to open position when the combustor 21 is in the liquid fuel buring mode or the dual or transition fuel burning mode.

Each injector nozzle 111 includes valve body 112 having a flow passage 113 formed therein having an inlet port 114 at the end of the flow passage in communication with the head space extension 42 and an outlet port 115 at the end of the flow passage 113 in communication with the secondary combustion zone 52. The inlet port 114 is opened and closed by means of a movable valve head or actuator plate 116 which is connected to the end of an actuating arm or stem 117 having a piston 118 at the opposite end from the actuator plate 116 which is slidably disposed in a cylinder 119 of a fluidic housing 120 mounted in the wall of the outer-casing 35 as is clearly shown in FIGS. 12 and 13 of the drawings. A spring 121 in the fluidic housing 120 normally maintains the valve head or actuator plate 116 in closed position and any suitable fluidic means such as hydraulic fluid or pneumatic fluid may be utilized and passed through conduit 122 into cylinder 119 to move the piston 118 and the actuator 116 connected thereto to open position whenever the combustor 21 is operated in the liquid fuel burning mode or dual fuel burning mode.

When the valve head or actuator plate 116 is moved to open position, air is allowed to pass from the head cavity extension space 42 through the inlet port 114, flow passage 113 and outlet port 115 into the secondary combustion zone 52 and the number of injector nozzles will be opened as required to supply the proper amount of air to maintain the flame stability and temperature profile of the hot combustion gases passed to the turbine 23. Since the fluidic actuator housing 120 is in the wall of the outer casing 35 the same is accessible for any maintenance which may be required and for the attachment of the fluidic conduit for operating the injector nozzles 111.

Additionally the lips of the respective valve bodies 112 on each of the injector nozzles 111 are slightly raised above the wall surface of the intermediate lower wall section 51 so that the inlet openings 114 of the respective injector nozzles 111 are raised slightly above the wall surface and thereby avoid the thick boundary layer of air adjacent the wall surface from creeping into the inlet opening to cause unnecessary jet momentum loss of the air delivered from the head cavity extension space into the secondary combustion zone 52.

FIGS. 14 and 15 further show that the valve head or actuator plate 116 for each of the injector nozzles 111 are provided with a plurality of flow control grooves as at 123 which extend therethrough at an angle as indicated. The purpose of grooves 123 is to allow air in the head cavity extension 42 to leak through the respective actuator plates 116 when the nozzle is in the closed position during the gaseous fuel burning mode so as to wash the inner walls of the valve housing 112 to prevent them from overheating when the injector nozzles are closed.

Thus combustion air delivered to the head cavity 29 can pass freely into the head cavity extension 42 and into the air swirler 83 as will be clear from the above description.

A major portion in the order of 31% of the air enters from the head cavity through the air swirler into the primary combustion zone 42 to provide the required fuel-air mixture to support combustion of the particular fuel being used.

An approximately constant additional percentage of the combustion air always will be metered into the secondary combustion zone 52 through bleed orifices 110 and through the slots or grooves 123 in the actuator plates 116 of the injector nozzles 111. Only during those periods of operation when the combustor is operating in the liquid or dual fuel burning mode will an additional volume of about 10 to 25% be injected into the secondary combustion zone 52 through the injector nozzles 111 for the reasons set forth above.

Figure 2:
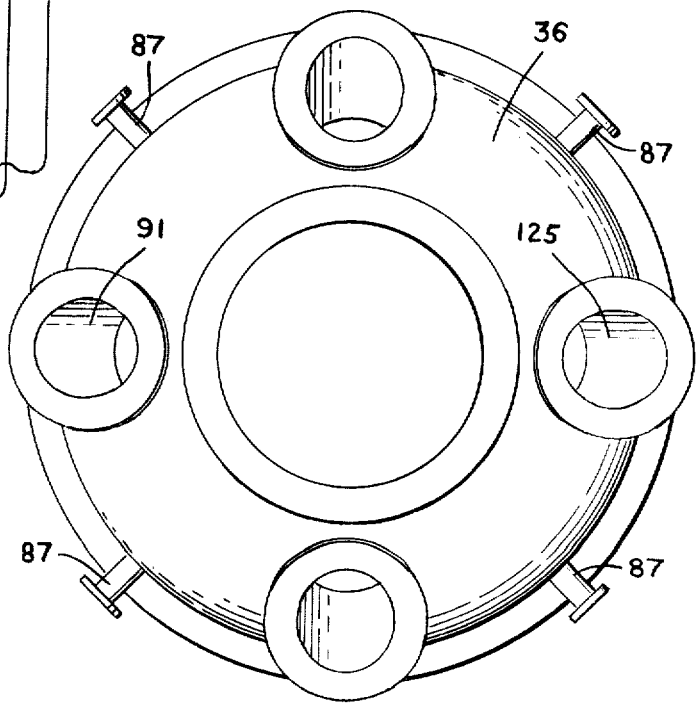
FIG. 2 is an enlarged top view of the fuel combustor shown in FIG. 1.

Accordingly, there will be an excess quantity of combustion air in the head cavity 39 and the bulk of this extra combustion air up to 50% thereof will be permitted to pass from the head cavity through purge openings as at 125 in the closure member 36 as shown in FIGS. 1, 2 and 3 of the drawings.

While the gas inlet 91 and purge outlet 125 are shown at 180° to each other, it will be clear that other arrangement of gas inlet and purge outlet can be provided without departing from the scope of the present invention.

OPERATION

LIQUID FUEL BURNING MODE

The combustor 21 for the reasons set forth above will always be started in the liquid fuel burning mode. However, after the combustor has been in operation and the 60% load level has been reached, the combustor may be alternatively and selectively switched between the liquid fuel burning mode to the gaseous fuel burning mode and vice versa through a dual fuel burning transition mode by rather simple procedures as will be clear from the description of the operation as will now be set forth.

For the liquid fuel burning mode, hydraulic or pneumatic fluid is delivered to the cylinder 119 in the respective fluidic housings 120 where it acts on the pistons 119 therein to move the respective actuating plates 116 of the injector nozzles 111 from the normally closed to open position.

Compressed air from the compressor is delivered through the inlet 26 and this air flows from the inlet 26 through air passage 27, cooling tubes 28 and diffuser 70 into the head cavity 39.

In the head cavity 39 the air splits into three portions. One portion passes to the head cavity extension 42 which is part of and continuous with the head cavity and then this portion flows through the open ports 114, flow passage 113 and outlet 115 of the respective injector nozzles 111 into the secondary combustion zone 52. A portion flows through the air swirler 83 and the remaining portion escapes through the purge opening 125 where it will be used for other process uses.

At a certain gas turbine fractional speed range during the starting phase, the liquid fuel injection means 88 is turned to on position and liquid fuel is combined with the incoming air in the ignition space or chamber 100. Ignition is commenced by simultaneously turning the liquid fuel ignition means to the on position and the combustor 23 begins operating by burning the mixture in the primary zone and in the secondary zone and the hot gases of combustion are discharged through the outlet 31 and line 32 to the inlet 33 of the turbine 23 and act to drive the turbine 23.

When a desired and stable part load level at the design speed for the turbine has been reached, combustor 21 can be controlled manually or automatically to permit the operation thereof to be switched alternately and selectively from the liquid fuel burning mode to the gaseous fuel burning mode now to be described.

GASEOUS FUEL BURNING MODE

The combustor is designed to normally operate with a gaseous fuel having a low heat content in order to take advantage of such gases as can be made available from processes and industrial operation which provide such gaseous fuel.

Therefore when gaseous fuel and more particularly gaseous fuel with low heat content is available then when the combustor has reached the desired load level switch-over from liquid fuel to the gaseous fuel can be accomplished through the operation of a minimum number of components.

Thus in order to switch over from liquid fuel to gaseous fuel, the valve 93 is opened to permit gaseous fuel to pass through line 92, conduit 91 to the gas collecting chamber 90. Whence it passes through outlets 94 and gas fuel manifold 95 into the air swirler 83 to charge the ignition space or chamber 100 where ignition of the gaseous fuel commences along with the already burning liquid fuel-air mixture.

Now the hydraulic or pneumatic fluid being delivered through conduit 122 to the cylinder 119 of the fluidic housing 120 is gradually terminated and the spring member 121 which is placed under compression when the hydraulic fluid moves the respective pistons 118 to open the actuating plates 116 will expand and cause the pistons 118 to move the actuating plate 116 in a slow and controlled manner to its normally closed position with respect to the inlet port 114 and this will prevent combustion air from flowing from the head cavity extension 42 through the flow chamber 113 in the injector nozzle 111 into the secondary combustion chamber 52 and only the air leaking from the head cavity expansion space through the grooves or slots 123 will then pass to the secondary combustion zone 52.

Thereafter liquid fuel being delivered through the liquid fuel injection nozzle is gradually reduced until the further operation of the combustor now continues on the gaseous fuel alone. The liquid fuel ignition means 101 is no longer needed and is therefore turned off.

This intermediate burning mode is thus a dual fuel burning mode or a transition burning mode and it will be obvious to those skilled in the art that this transition mode is equally applicable to changing from the gaseous fuel burning mode to the liquid fuel burning mode by merely reversing the prcedures i.e. feeding and igniting the liquid fuel and then terminating delivery of the gaseous fuel.

The combusting gaseous fuel-air mixture similar to the liquid fuel-air mixture expands through the primary combustion zone 47 and secondary combustion zone 52 and the hot gases of combustion will be discharged from the combustor through the discharge outlet 31 where the pass through line 32 to the inlet 33 of turbine 23 for driving the same.

During the transition burning mode, the purge valve 125 will be adjusted so as to draw off the proper percentage of excess combustion air which reaches the head cavity 39.

Thus the present invention provides a unique arrangement of cooling components which insures safe combustion chamber wall temperature during operation of a combustor having these improved structural arrangements thereon and further provides an improved combustor utilizing such improved cooling components designed and adapted for burning multiple and varied fuels both liquid and gaseous and more particularly for burning gaseous fuels with low heat content such as process off-gas which is made available from a shale oil extraction process.

The improved combustor for operating on liquid and gaseous fuels overcomes the start-up combustion difficulties so that liquid fuel may be burned in the start-up and transition modes and gaseous fuel with low heat content can be burned in the normal operating mode for the combustor.

It will be understood that the invention is not to be limited to the specific construction or arrangement of parts shown but that they may be widely modified within the invention defined by the claims.

What is claimed is:

1. A reverse flow combustor for providing hot combustion gases comprising, a. hollow outer casing means closed at one end to form a head cavity adjacent the closed end, b. hollow annular inner casing means connected in the outer casing means in spaced relation thereto to define therewith an annular head cavity extension space, and a discharge outlet for said combustor, c. said inner casing means also defining, a primary combustion zone, and a secondary combustion zone in communication with said primary combustion zone and said discharge outlet, d. an inlet assembly mounted in said outer casing means for communication with said head cavity to receive combustion air therefrom, e. a liquid fuel inlet connected to said outer casing means, f. a gaseous fuel inlet connected to said outer casing means, g. means operative to control alternately, simultaneously and selectively the flow of liquid fuel and gaseous fuel to said combustor, h. said inlet assembly connected to said liquid fuel inlet and gaseous fuel inlet and disposed to provide a mixture of at least one of said fuels and air to said primary combustion zone, i. air inlet means for said combustor at the end of the outer casing remote from the head cavity including, air flow passage means to pass combustion air entering said combustor in a direction counter to the flow of combustion gases, j. cooling means removably and replaceably connectible to the inner wall of said inner casing means and disposed about the primary combustion zone, including, a plurality of circumferentially disposed cooling tubes having one end connected to the air flow passage means to receive air entering the combustor and the opposite end having an outlet disposed to discharge the air to the head cavity in the outer casing, k. adjustable metering means connected to the inner casing means to provide predetermined quantities of additional air for mixture and temperature control of combustion gases in the secondary combustion zone of the combustor, and, l. said adjustable metering means includes, a fixed orifice bleed means for metering a predetermined quantity of air to said secondary combustion zone during all operating modes of the combustor.

2. In a reverse flow combustor as claimed in claim 1 wherein said cooling tubes are sized and shaped to facilitate the circumferential spacing thereof about the inner surface of the combustion chamber.

3. In a reverse flow combustor as claimed in claim 1 wherein said cooling tubes are elliptical in cross-section.

4. In a reverse flow combustor as claimed in claim 1 wherein said cooling tubes are round in cross-section.

5. In a reverse flow combustor as claimed in claim 1 wherein said cooling tubes are oval in cross-section.

6. In a reverse flow combustor as claimed in claim 1 wherein each of said plurality of removable and replaceable cooling tubes includes, a. at least one pair of spaced longitudinally extending fins on the sides of each of said plurality of cooling tubes, b. said cooling tubes connected to the inner surface of the combustion chamber whereby in assembled position the respective pair of fins on each of said plurality of cooling tubes are disposed to overlap the next adjacent pair of fins, and c. means on each of said fins to permit hot combustion gases to flow about each of said plurality of cooling tubes to dissipate heat to the wall sides thereof and to substantially prevent direct exposure of the inner surface of the combustion chambers to the direct heat of said hot combustion gases.

7. In a reverse flow combustor as claimed in claim 1 wherein said cooling tubes are supported on the inner surface of said inner casing means by hooks and are guided along their paths by a series of pins whereby said tubes have limited freedom of movement to minimize thermal stresses produced by uneven inner wall temperature in the primary combustion zone of the inner casing means.

8. In a reverse flow combustor as claimed in claim 1 including, a. an air swirler means in said inlet assembly disposed to communicate with the primary combustion zone in said inner casing means, b. said air swirler means having spaced gaseous fuel passage means and air passage means for mixing gaseous fuel and air being passed into the primary combustion zone during the normal gaseous fuel burning mode of the combustor, and c. said air passage means extending end to end through said air swirler means to permit air delivered therethrough to mix with liquid fuel passing to said primary combustion zone during the liquid fuel burning mode.

9. In a reverse flow combustor as claimed in claim 8 including, a. liquid fuel inlet means connected to said outer casing and extending into said air swirler means, b. said liquid fuel inlet means is a nozzle concentrically located in said air swirler means, said nozzle having an outlet in communication with the primary combustion zone.

10. In a reverse flow combustor as claimed in claim 8 including, a. gaseous fuel inlet means connected to said outer casing and connected to said air swirler means, b. said gaseous fuel inlet means including, a plenum, and ducting for channeling said gaseous fuel from said plenum to said gaseous fuel passage means in the air swirler means.

11. In a reverse flow combustor as claimed in claim 1 including, a. an air swirler means in said inlet assembly disposed to communicate with the combustion chamber, b. said air swirler means having a plurality of longitudinally extending vanes therein defining at least one air flow passage, and at least one gas flow passage extending end to end therethrough, c. said vanes shaped to form an ignition space at the end of said air swirler in communication with the combustion chamber, d. the air passages in said air swirler in communication at one end with the head cavity and at the other end with said ignition space, e. the gas flow passages in communication with said gaseous fuel inlet at one end and at the other end with said ignition space.

12. A reverse flow combustor for providing hot combustion gases comprising, a. hollow outer casing means closed at one end to form a head cavity adjacent the closed end, b. hollow annular inner casing means connected in the outer casing means in spaced relation thereto to define therewith an annular head cavity extension space, and a discharge outlet for said combustor, c. said inner casing means also defining, a primary combustion zone, and a secondary combustion zone in communication with said primary combustion zone and said discharge outlet, d. an inlet assembly mounted in said outer casing means for communication with said head cavity to receive combustion air therefrom, e. a liquid fuel inlet connected to said outer casing means, f. a gaseous fuel inlet connected to said outer casing means, g. means operative to control alternately, simultnaeously and selectively the flow of liquid fuel and gaseous fuel to said combustor, h. said inlet assembly connected to said liquid fuel inlet and gaseous fuel inlet and disposed to provide a mixture of at least one of said fuels and air to said primary combustion zone, i. air inlet means for said combustor at the end of the outer casing remote from the head cavity including, air flow passage means to pass combustion air entering said combustor in a direction counter to the flow of combustion gases, j. cooling means connected to the inner wall of said inner casing means including a plurality of circumferentially disposed cooling tubes having one end connected to the air flow passage means to receive air entering the combustor and the opposite end having an outlet disposed to discharge the air to the head cavity in the outer casing, k. adjustable metering means connected to the inner casing means to provide predetermined quantities of additional air for mixture and temperature control of combustion gases in the secondary combustion zone of the combustor, and, l. said adjustable metering means includes, 1. a fixed orifice bleed means for metering a predetermined quantity of air to said secondary combustion zone during all operating modes of the combustor, 2. a plurality of adjustable normally closed valve means, and 3. means for moving each of said plurality of valve means from closed to open position to vary the total quantity of additional air supplied to said secondary combustion zone.

13. A gas turbine arrangement including a comnbustor, a compressor for providing compressed air to said combustor in order to drive said turbine, the combustor comprising:

a. a hollow outer shell one end of which is closed, b. a hollow inner combustion wall defining a combustion chamber therein, said wall positioned within said outer shell and being spaced from outer shell to form an annular passageway between said shell and said wall for receiving said compressed cooling and combustion air therein in a direction contra to the flow of combustion mixtures in said combustion chamber, c. means in the closed end of said shell for injecting fuel into said combustion chamber, d. means for injecting air into said combustion chamber to support combustion of said fuel, and e. a plurality of open-ended tubes annularly arranged around the inside surface of said inner combustion wall and removably and replaceably supported thereby, the openings of said tubes at one end thereof communicating with said annular passageway to said tube is adapted to cool said inner combustion wall, the openings of said tubes at the other end thereof communicating with the head cavity to deposit said air from said tubes in said head cavity for passage into the combustion chamber to support the combustion of fuel, and f. said tubes are supported on said inner combustion wall by hooks and are guided along their paths by a series of pins whereby said tubes have limited freedom of movement to minimize thermal stresses produced by heat from said combustion chamber.

* * * * *